US005327716A

United States Patent [19]

Giffin, III et al.

[11] Patent Number: 5,327,716

[45] Date of Patent: Jul. 12, 1994

[54] SYSTEM AND METHOD FOR TAILORING ROTOR TIP BLEED AIR

[75] Inventors: Rollin G. Giffin, III; Harvey M. Maclin, both of Cincinnati, Ohio

[73] Assignee: General Electric Company, Cincinnati, Ohio

[21] Appl. No.: 55,944

[22] Filed: Apr. 29, 1993

Related U.S. Application Data

[63] Continuation of Ser. No. 896,638, Jun. 10, 1992, abandoned.

[51] Int. Cl.[5] ..... F02C 7/00

[52] U.S. Cl. ..... 60/39.02; 60/39.77; 415/144

[58] Field of Search ..... 60/39.02, 39.07, 726; 415/144, 145, 169

[56] References Cited

U.S. PATENT DOCUMENTS

| | | | |
|---|---|---|---|
| 2,848,155 | 8/1958 | Hausmann | 415/144 |
| 3,632,223 | 1/1972 | Hampton | 415/144 |
| 4,155,221 | 5/1979 | Dhoore et al. | 415/145 |
| 4,546,605 | 10/1985 | Mortimer et al. | 60/39.07 |
| 4,844,689 | 7/1989 | Seed | 415/169.1 |
| 4,969,326 | 11/1990 | Blessing et al. | 60/226.1 |

OTHER PUBLICATIONS

Commonly-assigned U.S. patent application Ser. No. 07/478,304 by Rollin G. Giffin et al., filed Feb. 12, 1990 and entitled "Compressor Splitter for Use with a Forward Variable Area Bypass Injector" (presently under Secrecy Order).

*Primary Examiner*—Louis J. Casaregola

*Attorney, Agent, or Firm*—Jerome C. Squillaro; Nathan D. Herkamp

[57] ABSTRACT

A rotor tip bleed air tailoring system in which a rotor blade is located upstream from an outer stator vane and an inner stator vane. The inner stator vane and outer stator vane are separated by a splitter which extends to the tip region of the rotor blade and separates air exiting the rotor blade into regions of distinctly different pressures.

12 Claims, 2 Drawing Sheets

SYSTEM AND METHOD FOR TAILORING ROTOR TIP BLEED AIR

This application is a continuation of application Ser. No. 07/896,638, filed Jun. 10, 1992 abandoned.

BACKGROUND OF THE INVENTION

The present invention pertains to gas turbine engines, and more particularly, to a system and method for better utilizing rotor tip bleed air.

In the past, gas turbine engine pressurized bleed air has been used for a variety of functions which have included turbine cooling, nozzle cooling, purge, pressurization and customer bleed. The source of this pressurized bleed air is most often from the compression system. Rotor blades, in a given stage of a compressor, by performing work upon the air in the air flow path of the compressor, increase the pressure of the airflow. Thus, the downstream pressure in a compressor is greater than the upstream pressure. Stator vanes reduce the tangential momentum in the air received from the adjacent upstream rotor blades so that additional tangential momentum can be imparted by the next downstream rotor at more desirable inlet conditions.

Typically, bleed air is extracted upon exit from a stator vane as the flow path MACH number is lower at this location and the swirl is better controlled. The bleed air can then be piped through proper conduits to a desired user location. The pressure of the bleed air at its source (i.e., the exit point from the stator) must exceed the pressure required at its point of desired use since pressure is lost as air traverses through bends and corners in a conduit.

In a gas turbine engine, the compression process is generally divided into a number of stages. The location of each stator vane in a compressor can be viewed as a possible source of bleed air. Thus, in a given system, it is known what source pressure must exist to achieve a desired pressure at a user location. However, if the source pressure is too high, a system penalty will be introduced as a result of wasted and non-utilized work which of course contributes to engine inefficiency. It is desirable to reduce the number of compression stages to save weight, reduce parts count and lower cost. For the same overall component pressure ratio, the number of possible bleed sources is reduced thus making it more difficult to match the desired level of pressure.

For a hypothetical example, consider the following table:

| | STAGE N EXIT PRESSURE | STAGE N + 1 PRESSURE RATIO | STAGE N + 1 EXIT PRESSURE |
|---|---|---|---|
| CASE A | 100 | 1.30 | 130 |
| CASE B | 95 | 1.40 | 133 |
| CASE C | 110 | 1.40 | 154 |

Stage N in the above table has an exit pressure of 100 for Case A, an exit pressure of 95 for Case B and an exit pressure of 110 for Case C. The pressure can be viewed as total pressure psi. However, if bleed air, having a source pressure of 120 is required, an exit pressure at stage N is insufficient for Case A, Case B and Case C. In stage N+1, an excess exit pressure exists in Case A (130−120=10), an excess exists in Case B (133−120−13), and an excess exits in Case C (154−120=34). The selection of a stage for supplying bleed air depends on the pressure drop between the stage and zone of use.

In summary, if the pressure is insufficient, it cannot be utilized at all, but if it is too great, penalties result from the excess pressure. This excess pressure is a result of excess work being performed. The pressure in excess of the desired pressure results in wasted work which is a penalty to the system. If additional work is performed on the bleed air, the bleed air is given a higher temperature which necessitates a greater quantity of bleed air for cooling purposes.

Thus, a need exists for a system and method for obtaining a desired bleed air exit pressure to enhance engine efficiency.

SUMMARY OF THE INVENTION

The present invention is a bleed air tailoring system for a gas turbine engine which includes a rotor blade and inner and outer stator vanes. The outer stator vane is located downstream of the rotor blade and the inner stator vane is located radially inward from the outer stator vane. The system further includes a splitter for separating an airflow path into a radially outward region of air and a radially inward region of air. The radially outward region of air contacts the splitter, the outer stator vane and the radially outward region of the rotor blade. The radially inward region of air contacts the inner stator vane and a radially inward region of the rotor blade.

In the present invention a stage of stator vanes comprised of inward stator vanes and outward stator vanes is separated by an annular splitter (separating means) which separates the airflow path emanating from an adjacent rotor stage. This airflow path is divided into a high pressure region of airflow $P_1$ which traverses through the inward stator vanes and a low pressure region $P_2$ which traverses through the outer stator vanes. By decreasing the camber and/or clipping the aftward tip region of each rotor blade in the adjacent (immediate upstream) rotor stage to a predetermined amount, a desired exit pressure of the airflow entering the outward stator vanes can be achieved and the airflow can then be piped to a desired user location, with the airflow reaching the desired user location at a desired pressure.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, in which.

When referring to the drawings, it is understood that like reference numerals designate identical or corresponding parts throughout the respective figures.

THE DETAILED DESCRIPTION OF THE INVENTION

Figure 1:
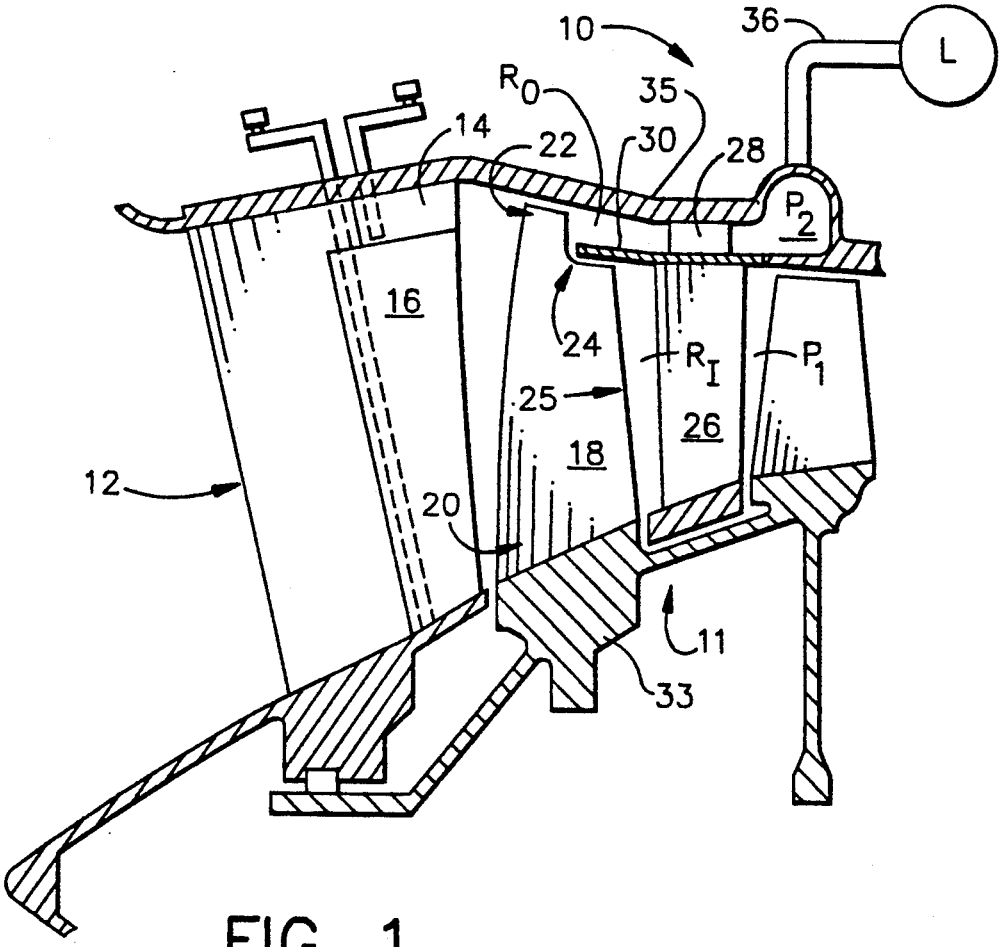
FIG. 1 is a simplified schematic illustration of the rotor tip bleed air tailoring system of the present invention.

With reference to FIG. 1, a rotor tip bleed air tailoring system 10, according to the present invention, is comprised of an upstream annular array of rotor blades 18, an inner annular array of stator vanes 26 and an outer annular array of stator vanes 28. The illustrative rotor tip bleed air tailoring system is implemented in a compressor 11 of a gas turbine engine, the engine being represented by compressor 11. It will be appreciated that cross-section of FIG. 1 is taken through an annular compressor section circumscribing the engine. Upstream of rotor blade 18 is positioned an inlet guide vane 12. Inlet guide vane 12 is comprised of a radially outer portion 14 and a radially inner portion 16. Although illustrated as a special design for the present invention, guide vane 12 may, in appropriate cases, be constructed in a conventional manner. Rotor blade 18 is comprised of a hub region 20, a tip region 22 and an optional clipped or cutaway aftward region 24. An aftward radially inward region or trailing edge 25 of rotor blade 18 is positioned radially inward from clipped aftward region 24 at the aftward extreme edge of the rotor blade. Downstream from rotor blade 18 is positioned inner stator vane 26 and outer stator vane 28. Separating means such as a splitter 30 positioned substantially parallel to the engine center line (not shown) is situated between inner stator vane 26 and outer stator vane 28. The splitter 30 extends to the clipped aftward region of the rotor blade 18 so that a region of air $R_O$ is formed which extends aft from the clipped aftward region 24 past the outer stator vane 28 and radially outward of the splitter 30. Also, the splitter 30 serves to form an inner region of air $R_I$ which is formed between the aftward radially inward region 25 of blade 18 and the inner stator vane 26. The splitter 30 extends downstream of the inner stator vane 26 and outer stator vane 28 with the region of air located directly downstream from the inner stator vane 26 having a pressure $P_1$ and the region of air located directly downstream from outer stator vane 28 having an air pressure $P_2$. A conduit 36 connects the region of air having a pressure $P_2$ with a user location L thus enabling bleed air to be extracted from the exit of outer stator vane 28 to a desired user location L. While vanes 26, 28 are illustrated to be on a common radial line, it will be appreciated that such arrangement is not required. The vanes 26,28 may be axially or circumferentially offset.

Stator vane 28 of FIG. 1 is positioned between outer casing 35 and splitter 30. Inner stator 26 is positioned between splitter 30 and inner casing 33. Splitter 30 can be welded or brazed to the outer stator 28 and inner stator 26 of FIG. 1. Splitter 30 is annular and extends all the way around the engine. Splitter 30 can be an integral annular ring or be comprised of contiguous segments.

Figure 2:
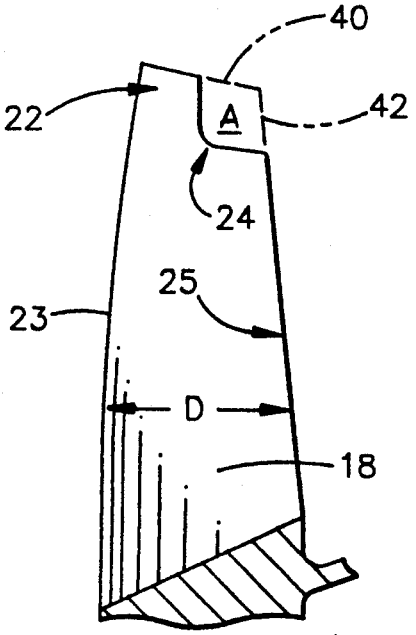
FIG. 2 is a schematic illustration of a clipped rotor blade according to the present invention.

In FIG. 2, the rotor blade 18 in one form of the present invention has an axial cord length D and extends from an upstream side 23 of the rotor blade 18 to the axially inward or downstream side 25. The tip region 22 of the rotor blade 18 has a clipped region 24, i.e., a region having an area A has been removed from the tip region 22 of blade 18. Were blade 18 not clipped, the radial exterior border of the blade would continue along dotted line 40 and the aftward border of blade 25 would continue along dotted line 42. The clipped region 24 allows an axially forward end of splitter 30 to extend forward of the normal trailing edge of blade 18. The advantages of this clipped region are described below.

Figure 3:
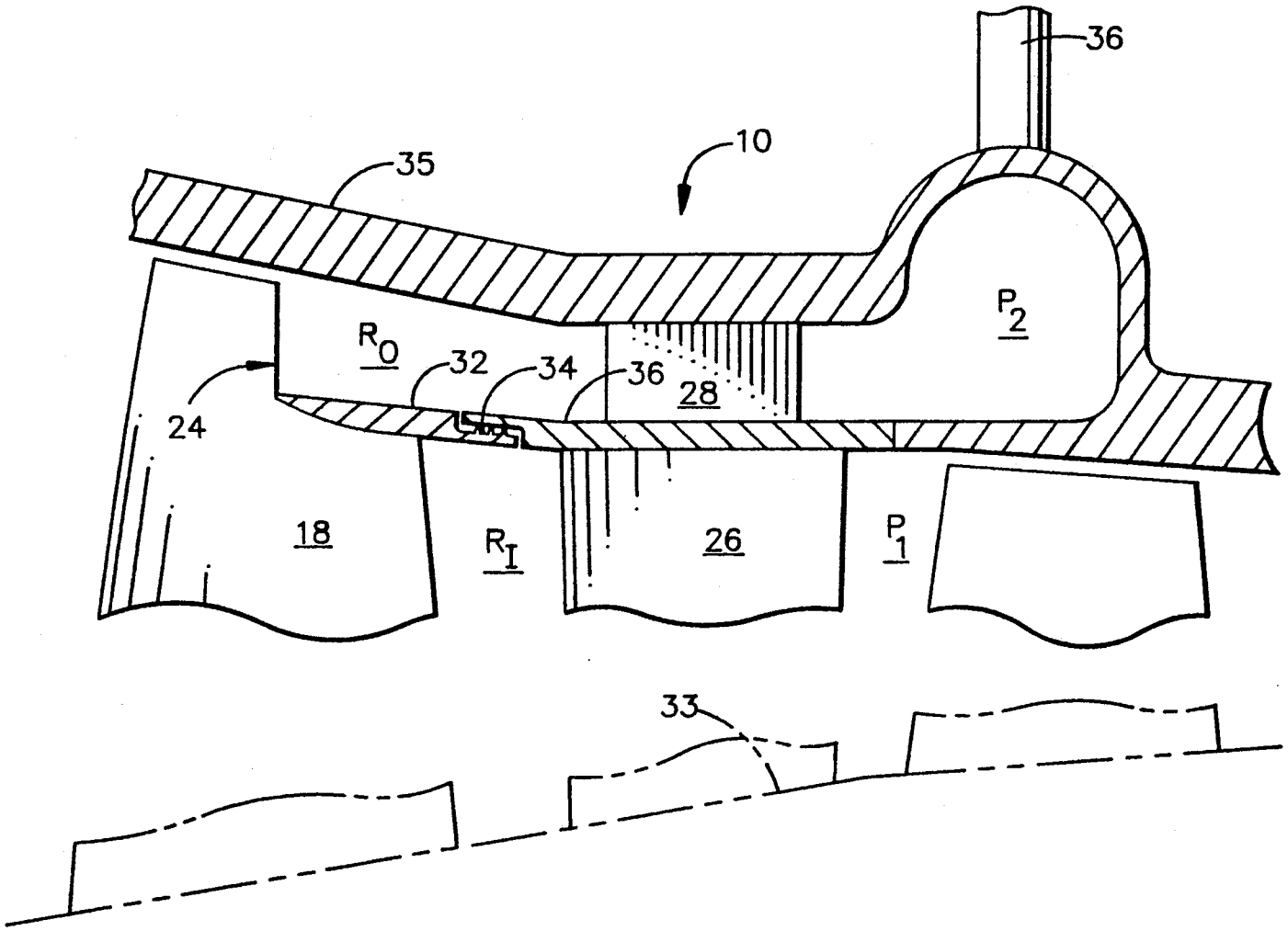
FIG. 3 is a simplified schematic illustration of a rotor tip bleed air tailoring system according to another embodiment of the present invention.

In FIG. 3, another embodiment of the present invention includes a two-piece splitter 30 having an annular rotating segment 32 which is affixed to rotor blade 18 at the clipped region 24. A stationary segment 36 of splitter 30 connects to and separates the radially outer stator vane 28 from the radially inner stator vane 26. A seal 34 is positioned between stationary segment 36 and rotating segment 32 to prevent region of air $R_I$ from leaking into region of air $R_o$. In practice, seal 34 could be a labyrinth seal, a brush seal, a carbon seal or other appropriate sealing means. Rotating segment 32, seal 34 and stationary segment 36 comprise an air separating means.

A radial profile of pressure from the tip (radially outer end) to the hub (radially inner end) of a typical rotor blade differs by only 3% to 4%. Thus, in general terms, in a typical rotor blade row of a gas turbine engine, the tip pressure is about 95% of the hub pressure. In the present invention, it is desired to further accentuate the difference in pressure from the tip to the hub region of the rotor blade and separate these regions so that a region of lower pressure $P_2$ to the aft of outer stator vane 28 exists apart from an area of pressure $P_1$ which is located to the aft of inner stator vane 26 (see FIGS. 1 and 3).

The area A (FIG. 2) of the clipped tip region of the rotor blade can be calculated so that a desired pressure is obtained in the location immediately downstream from outer stator vane 28 as a result of the splitter 30 separating airflow into two distinct pressure regions $P_1$ and $P_2$. Bleed air having a desired pressure can then be extracted from the low pressure region $P_2$ to be piped to a desired user location. Alternatively, i.e., without clipping the blades, a reduced pressure $P_2$ could be obtained by reducing the entry size into the outer region about splitter 30. Another method of reducing pressure without clipping the rotating blades is to decrease the camber of the blade near its tip end. These methods could also be combined with a clipped blade to obtain a further reduction in pressure.

The present invention allows tailoring a given compressor stage such that a desired exit pressure is achieved enabling bleed air to be used efficiently for innumerable uses. An example in the commercial airline industry is to use the bleed air for purposes of passenger ventilation. In the engine, bleed air can be used to cool the low pressure turbine. An example for use in military aircraft is to use the bleed air for purposes of cooling the numerous electronic boxes which help control the functions of the aircraft.

The above detailed description of the preferred embodiments of the present invention are intended to be illustrative and non-limited. Numerous changes and modifications are possible in light of the above teachings. It is understood that the invention may be practiced otherwise than it is specifically described herein and still be within the scope of the appended claims.

What is claimed is:

1. A bleed air tailoring system for extracting pressurized air from a gas turbine engine airflow path in a compressor stage of the engine, the compressor stage including at least one annular array of rotor blades for increasing air pressure in the airflow path and at least one annular array of inner stator vanes for directing air exciting the rotor blades, the airflow path being defined by inner and outer annular casings within which the blades and vanes are positioned, the improvement comprising:

separating means for separating the airflow path into a radially outward region of air and a radially inward region of air; and means for selectively extracting bleed air from said outward region of air;

wherein said separating means comprises an annular splitter extending axially forward into a cutaway portion formed in a radially outer, trailing edge of each of said blades of said at least one annular array of rotor blades for extracting air at a pressure less than the air pressure at the trailing edge of said blades.

2. A system according to claim 1, further comprising:

at least one outer stator vane located downstream of said rotor blade in the radially outward region of air;

wherein said radially outward region of air extends aft from said cutaway portion of each of said blades past said at least one outer stator vane and radially outward of said splitter.

3. A bleed air tailoring system for extracting pressurized air from a gas turbine engine airflow path in a compressor stage of the engine, the compressor stage including at least one annular array of rotor blades for increasing air pressure in the airflow and at least one annular array of inner stator vanes for directing air exiting the rotor blades, the airflow path being defined by inner and outer annular casings within which the blades and vanes are positioned, the improvement comprising:

separating means for separating the airflow path into a radially outward region of air and a radially inward region of air; and means for selectively extracting bleed air from said outward region of air;

wherein said separating means comprises an annular splitter extending axially forward from an inner surface of the outer annular casing from a circumferential line located axially aft of the at least one annular array of rotor blades, said splitter including;

an axially forward segment attached to the rotating blades for rotation therewith;

an axially aft segment extending into a mating position adjacent said forward segment; and seal means between said forward and aft segments at said mating position for inhibiting air leakage therebetween.

4. A bleed air tailoring system for extracting pressurized air from a gas turbine engine airflow path in a compressor stage of the engine, the compressor stage including at least one annular array of rotor blades for increasing air pressure in the airflow path and at least one annular array of inner stator vanes for directing air exiting the rotor blades, the airflow path being defined by inner and outer annular casings within which the blades and vanes are positioned, the improvement comprising:

separating means for separating the airflow path into a radially outward region of air and a radially inward region of air;

means for selectively extracting bleed air from said outward region of air; and at least one outer stator vane located downstream of said rotor blade in the radially outward region of air;

wherein said separating means comprises an annular splitter extending axially forward from an inner surface of the outer annular casing from a circumferential line located axially aft of the at least one annular array of rotor blades, said splitter being attached to the annular array of inner stator vanes;

wherein said splitter comprises:

an axially forward segment attached to the rotating blades for rotation therewith;

an axially aft segment extending into a mating position adjacent said forward segment; and seal means between said forward and aft segments at said mating position for inhibiting air leakage therebetween.

5. A bleed air tailoring system for extracting pressurized air from a gas turbine engine airflow path in a compressor stage of the engine, the compressor stage including at least one annular array of rotor blades for increasing air pressure in the airflow path and at least one annular array of inner stator vanes for directing air exiting the rotor blades, the airflow path being defined by inner and outer annular casings within which the blades and vanes are positioned, the improvement comprising:

separating means for separating the airflow path into a radially outward region of air and a radially inward region of air and means for selectively extracting bleed air from said outward region of air;

at least one outer stator vane located downstream of said rotor blade in the radially outward region of air;

wherein said separating means comprises an annular splitter extending axially forward from an inner surface of the outer annular casing from a circumferential line located axially aft of the at least one annular array of rotor blades, said splitter being attached to the annular array of inner stator vanes;

wherein said blades in said annular array of rotating blades are each formed with a cutaway portion in a radially outer, trailing edge, said splitter extending into said cutaway portion for extracting air at a pressure less than the air pressure at the trailing edge of said blades.

6. The system of claim 5 wherein said splitter comprises:

an axially forward segment attached to the rotating blades for rotation therewith;

an axially aft segment extending into a mating position adjacent said forward segment; and seal means between said forward and aft segments at said mating position for inhibiting air leakage therebetween.

7. The system of claim 6 wherein said axially forward segment is attached to a radially inner surface of said blades within said cutaway portion.

8. The system of claim 5 wherein said cutaway portion extends axially forward of the blade trailing edge a preselected distance for establishing a pressure in said outward region within a preselected range.

9. A method for obtaining bleed air at a preselected pressure from a compressor stage of a gas turbine engine, the compressor stage having an inner and an outer casing, at least one rotating blade stage and at least one stator vane stage, the method comprising the steps of:

forming a secondary annular airflow path within the compressor stage by extending a secondary annular member axially forward from a location axially aft of the at least one stator vane stage to a location adjacent a tip end of the at least one rotating blade stage; and capturing bleed air from adjacent the tip end of the at least one rotating blade stage in the secondary annular airflow path;

wherein said step of forming includes the steps of:

attaching a forward portion of the secondary annular member to the at least one rotating blade stage and attaching an aft portion of the secondary annular member to the at least one stator vane stage;

inhibiting air leakage between the forward and aft portions of the secondary annular member by positioning a seal means between the forward and aft portions.

10. A method for obtaining bleed air at a preselected pressure from a compressor stage of a gas turbine engine, the compressor stage having an inner and an outer casing, at least one rotating blade stage and at least one stator vane stage, the method comprising the steps of:

forming a secondary annular airflow path within the compressor stage by extending a secondary annular member axially forward from a location axially aft of the at least one stator vane stage to a location adjacent a tip end of the at least one rotating blade stage; and capturing bleed air from adjacent the tip end of the at least one rotating blade stage in the secondary annular airflow path;

wherein the preselected pressure is determined by the steps:

clipping a tip end of each blade of the at least one rotating blade stage on an axially aft corner thereof for forming a cutaway portion; and extending the secondary annular member into the cutaway portion for obtaining bleed air at a preselected pressure.

11. A method for obtaining bleed air at a preselected pressure from a compressor stage of a gas turbine engine, the compressor stage having an inner and an outer casing, at least one rotating blade stage and at least one stator vane stage, the method comprising the steps of:

forming a secondary annular airflow path within the compressor stage by extending a secondary annular member axially forward from a location axially aft of the at least one stator vane stage to a location adjacent a tip end of the at least one rotating blade stage; and capturing bleed air from adjacent the tip end of the at least one rotating blade stage in the secondary annular airflow path;

adjusting the camber of each blade of the at least one rotating blade stage for establishing a preselected air pressure at the blade tip end.

12. A method for obtaining bleed air at a preselected pressure from a compressor stage of a gas turbine engine, the compressor stage having an inner and an outer casing, at least one rotating blade stage and at least one stator vane stage, the method comprising the steps of:

forming a secondary annular airflow path within the compressor stage by extending a secondary annular member axially forward from a location axially aft of the at least one stator vane stage to a location adjacent a tip end of the at least one rotating blade stage; and capturing bleed air from adjacent the tip end of the at least one rotating blade stage in the secondary annular airflow path;

reducing the entry area between the outer casing and the secondary annular member for establishing a preselected pressure of the captured air.

* * * * *